United States Patent [19]

Chaffin et al.

[11] Patent Number: 5,002,246

[45] Date of Patent: Mar. 26, 1991

[54] CONTAINER DRAIN SUPPORT

[76] Inventors: Mary G. Chaffin; Thomas R. Chaffin, both of R.R. #4, 1203 Foster Creek Dr., Richmond, Tex. 77469; William E. Rogge; Patricia A. Rogge, both of 2202 N. East St., Belton, Tex. 76513

[21] Appl. No.: 516,562

[22] Filed: Apr. 30, 1990

[51] Int. Cl.[5] ..... A47G 23/02

[52] U.S. Cl. ..... 248/153; 248/311.3

[58] Field of Search ..... 248/153, 107, 117.2, 248/133, 311.3, 175; 211/74, 41; 141/372, 364, 375; D7/619, 220, 221, 312

[56] References Cited

U.S. PATENT DOCUMENTS

| | | | |
|---|---|---|---|
| 932,344 | 8/1909 | Starbard | 248/107 X |
| 1,322,656 | 11/1919 | Treadwell et al. . | |
| 1,736,346 | 11/1929 | Jeep | 248/107 |
| 2,211,227 | 8/1940 | Feindel | 248/107 |
| 2,243,870 | 6/1941 | Klaus | 248/107 |
| 2,534,345 | 12/1950 | Farrar | 134/49 |
| 2,648,513 | 8/1953 | Groff | 248/107 |
| 2,925,235 | 2/1960 | Jaros | 248/153 |
| 3,054,588 | 9/1962 | Ondrasik | 248/117.2 |
| 3,181,701 | 4/1965 | Cole | 211/74 |
| 3,286,849 | 11/1966 | Dominos | 211/74 |
| 3,615,150 | 10/1971 | Indrunas | 141/375 |
| 3,814,293 | 6/1974 | Daves | 222/173 |
| 3,908,952 | 9/1975 | Von Alven | 248/360 |
| 3,955,682 | 5/1976 | Baren | 211/74 |
| 4,150,806 | 3/1979 | Dziuk | 248/311.3 X |
| 4,217,941 | 8/1980 | Catalano | 141/372 |
| 4,454,897 | 6/1984 | Valiant | 141/364 |
| 4,496,124 | 1/1985 | Cole | 248/146 |
| 4,589,556 | 5/1986 | Peretz | 211/41 |

*Primary Examiner*—Ramon O. Ramirez
*Assistant Examiner*—Robert A. Olson
*Attorney, Agent, or Firm*—Jack W. Hayden

[57] ABSTRACT

A container drain support including a base with a support to receive and position various shaped containers with or without a neck to drain substance from the container without the substance contacting the container.

3 Claims, 1 Drawing Sheet

FIG. 1
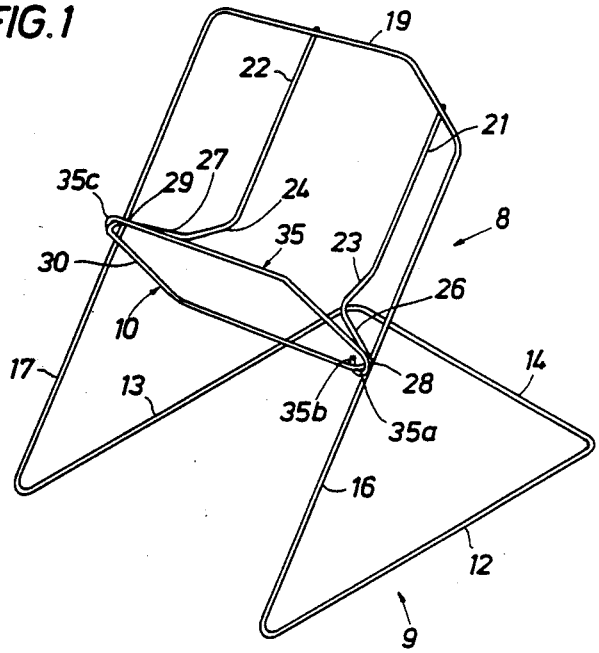
FIG. 3
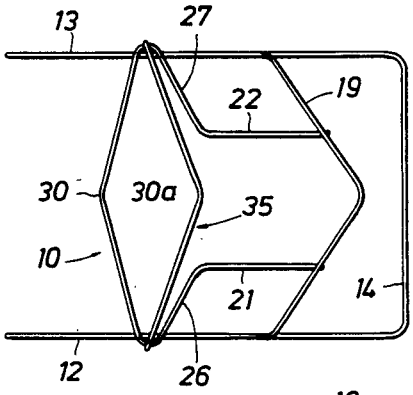
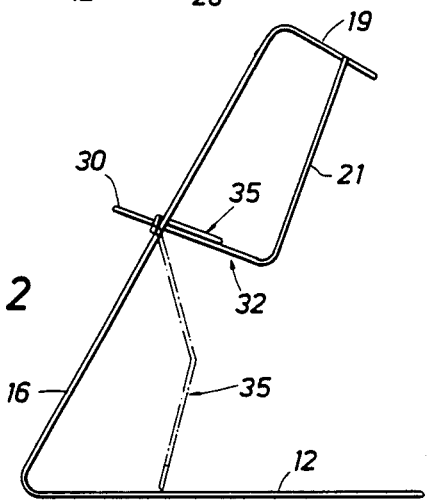
FIG. 2
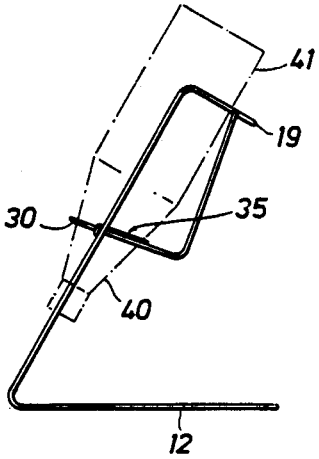
FIG. 4
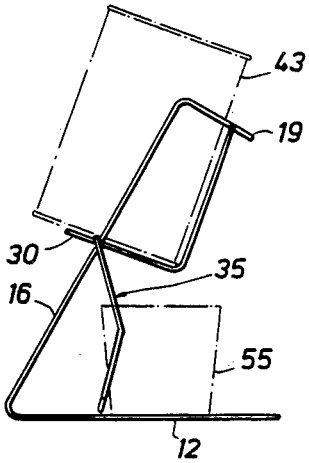
FIG. 5
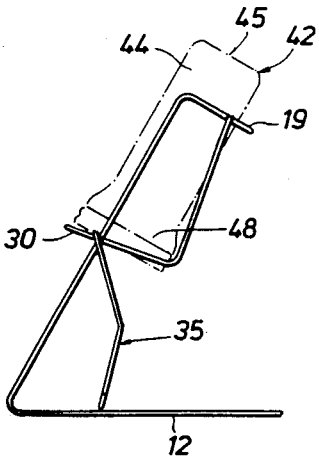
FIG. 6

CONTAINER DRAIN SUPPORT

STATEMENT OF THE PRIOR ART

Various types of container drains have been proposed for supporting a container such as a bottle or the like for emptying all or a portion of the contents of such container. Generally speaking, the supports with which applicants are familiar are limited as to the type and size of containers which can be received therein. For example, some bottles or containers are relatively long and narrow with small openings therein such as baby bottles or ketchup bottles. Other types of bottles or container are wider and have larger openings such as mayonnaise jars. Others types of bottles or containers have relatively large openings but whose body is relatively wide in lateral extent relative to a smaller width.

Applicants are not familiar with any container drain support which can accommodate various shaped glass, plastic or metal containers with varying size necks.

SUMMARY OF THE INVENTION

The present invention provides a container drain support which is constructed and arranged to receive containers of various configurations of body and various size necks with openings therein.

An object of the present invention is to provide a container support or device which can receive relatively long and narrow bottles such as a baby or ketchup bottle with a neck therein, or a wide bodied container having a larger opening than is found in a baby or ketchup bottle as well as a metal can or plastic container which has an opening that may in some instances be as large as the diameter of the container itself.

Other objects and advantages of the present invention will become apparent from a consideration of the following description and drawings.

BRIEF DESCRIPTION OF THE DRAWINGS

FIG. 1 is an isometric view of an embodiment of the present invention;

FIG. 2 is a side view showing in dotted line one of the container braces in a position when not employed;

FIG. 3 is a top plan view showing the preferred embodiment of the present invention with the movable brace shown in dotted line in FIG. 2 in position;

FIG. 4 is a side view illustrating the present invention employed with a baby or ketchup bottle type container;

FIG. 5 shows the brace support illustrated in FIGS. 1, 2 and 3 with a larger diameter container which may have a larger opening therein for drainage of the contents therefrom; and FIG. 6 illustrates another style of container which can be employed with the present invention.

DESCRIPTION OF THE PREFERRED EMBODIMENTS

Attention is first directed to FIG. 1 wherein the container support is referred to generally by the numeral 8.

The construction of the invention will be described in terms of plastic or metal wire of suitable gauge to sustain the weight of the containers to be maintained in the support 8. However, it can be appreciated that the support can be formed of any suitable material in any suitable arrangement to provide the desired size opening to receive the neck of a bottle therethrough and may include a pivotally mounted brace, or member, which can be secured in position on the support 8 to provide a yoke referred to generally at 10 that provides an opening 30*a* for receiving the neck of a container to assist in maintaining the container in position on the support while it drains. The opening 30*a* in the yoke 10 is configured to receive various size and shapes of container necks, as illustrated in FIG. 3 of the drawings. The pivotally mounted brace can be moved aside when larger container are to be received in the support for draining the contents thereof so that the contents of the container will not contact the support during draining.

In FIG. 1 a support base referred to generally by the numeral 9 is shown as being formed of rods or wires and includes opposite, spaced and preferably parallel side wires or members 12 and 13 which are connected by the bar 14 extended therebetween at the rear to form a base on the drain support 8.

The side members 12 and 13 are bent to form supporting arms 16 and 17 which extend upwardly and are inclined inwardly at an acute angle relative to the base formed by the members 12, 13 and 14.

A concave cross-bar 19 extends between and adjacent the upper ends of the members 16 and 17 as shown and also extends or projects rearwardly from the plane between the support arms 16 and 17.

Spaced braces 21 and 22 extend downwardly from the cross-bar 19 and are in a plane spaced rearwardly from the plane extending through the supporting arms 16 and 17 as more clearly shown in FIGS. 2-6 of the drawings. The spaced braces 21 and 22 include portions 23, 24 which extend forwardly from the braces 21 and 22 at their lower ends and may preferably be aligned with the longitudinal axis of the braces 21, 22. Portions 26 and 27 flare outwardly from the portions 23, 24, respectively, toward arms 16, 17, respectively, to connect with 16, 17, respectively, by any suitable means such as welding or the like represented at 28 and 29. This connects the portions 26, 27 in a horizontal plane through the connections 28, 29 which plane is elevated relative to the horizontal plane which extends through the supporting arms 12 and 13 of support base 9.

A convex support brace or cross-bar 30 extends from or adjacent the connections 28 and 29 and projects forwardly of the plane between the supporting arms 16 and 17.

The convex cross-bar 30, flared portions 26, 27 and forwardly extending portions 23 and 24 are generally and preferably in more or less approximately the same plane as more clearly seen and represented generally at 32 in FIGS. 2-6 for receiving and supporting a container thereon. Where the container includes an extending neck portion of reduced size relative to the container, a concave support brace or cross-bar referred to generally at 35 may be employed to provide the yoke referred to generally at 10 which receives such neck in the space or opening 30*a* between concave cross-bar 35 and convex cross bar 30. This assists in retaining the container in position on the support 8. It will be noted that the concave metal brace 35 includes an end portion with a hook 35*a* configured to pivotally connect one end 35*b* of the concave brace 35 adjacent the connection of one of the supporting arms with either portion 26 or convex cross-bar 30 while the other end of cross-bar 35 is provided with a suitable hook configuration 35*a* to enable it to be removably hooked or secured adjacent the connection 29 either with the flared portion 27 or adjacent the other end of the brace 30 and the supporting arm 17. This provides the opening 30*a* of suitable size between the concave cross-bar 35 and convex cross-bar 30 for receiving the neck 40 of a container such as a baby bottle or ketchup bottle represented in dotted line at 41 in FIG. 4. The cross-bar 35 is shown as extending parallel to the flared portions 26, 27 in FIG. 2, but its configuration is such that when it is in position as shown in FIGS. 2 and 4, it will sag below the plane of portions 26, 27. This provides a somewhat more stable support arrangement for a container.

Where the container to be drained has a larger body such as that illustrated at 43 in FIG. 5, it may be desirable to disconnect the hook 35*c* and remove the concave cross-bar 35 so that it is supported or hangs on the support 8 as shown in FIG. 5 of the drawings whereby the container 43 may be received on the drain support 8 of the present invention and the contents thereof drained to a container as represented at 55 without the container contents contacting the support.

FIG. 6 illustrate another configuration of a glass or plastic container 42 whose body is relatively narrow as illustrated in relation to the width of the body represented by the numeral 45 at the bottom of the upturned container.

In this instance also, the container represented by the numeral 42, includes the large mouth or opening 48, and the concave cross-bar 35 is shown disconnected from the drain support 8 at one end so that it will hang free by the hook 35*b* at its other end. If it has a smaller mouth or a neck, then the convex cross-bar may be positioned on the holder as represented in FIGS. 1, 2 and 4.

From the foregoing description it can be appreciated that the drain support of the present invention readily receives variously configured containers for draining the contents therefrom. The configuration of the drain support 8 maintains the container to be drained in position during draining and also enables the draining to occur without the substance from the container contacting support 8 to avoid contamination of the substance.

The foregoing disclosure and description of the invention are illustrative and explanatory thereof, and various changes in size, shape and materials as well as in the details of the illustrated construction may be made without departing from the spirit of the invention.

What is claimed is:

1. A container drain support including:

a support base;

support arms extending upwardly and inwardly at an acute angle relative to said base, said support arms having upper ends;

a concave cross-bar extending between said support arms adjacent their upper end;

spaced braces extending downwardly from said concave cross-bar, said spaced braces having brace portions at their lower ends that extend forwardly and extend outwardly relative to said spaced braces to connect with said support arms in elevated relation to said support base; and a convex cross-bar extending between said support arms adjacent the connection of said brace portions with said support arms.

2. The container drain support of claim 1 including a concave support brace having first and second ends, with said first end pivotally supported adjacent the connection of one of said brace portions with one of said support arms and the second end of said concave support brace having a hook to engage adjacent the connection of the other of said brace portions with the other of said support arms to extend and position said concave support brace between said support arms.

3. The container drain support of claim 1 wherein said brace portions that extend forwardly are aligned in a plane with the longitudinal axis of said spaced braces.

* * * * *